US011371666B2

(12) United States Patent
Tan

(10) Patent No.: US 11,371,666 B2
(45) Date of Patent: Jun. 28, 2022

(54) LINEAR LUMINAIRE

(71) Applicant: OPPLE LIGHTING CO., LTD., Shanghai (CN)

(72) Inventor: Xingchen Tan, Shanghai (CN)

(73) Assignee: Opple Lighting Co., Ltd., Shanghai (CN)

( * ) Notice: Subject to any disclaimer, the term of this patent is extended or adjusted under 35 U.S.C. 154(b) by 0 days.

(21) Appl. No.: 17/137,225

(22) Filed: Dec. 29, 2020

(65) Prior Publication Data

US 2021/0116080 A1 Apr. 22, 2021

Related U.S. Application Data

(63) Continuation of application No. PCT/CN2019/096242, filed on Jul. 12, 2019.

(30) Foreign Application Priority Data

Jul. 16, 2018 (CN) ..... 201821124991.4

(51) Int. Cl.
*F21S 4/28* (2016.01)
*F21V 21/005* (2006.01)
*F21Y 103/10* (2016.01)

(52) U.S. Cl.
CPC ..... *F21S 4/28* (2016.01); *F21V 21/005* (2013.01); *F21Y 2103/10* (2016.08)

(58) Field of Classification Search
CPC ..... F21Y 2103/10; F21V 21/005; F21S 4/28
See application file for complete search history.

(56) References Cited

U.S. PATENT DOCUMENTS 9,618,194 B2 * 4/2017 Tress ..... F21V 23/006
10,634,292 B1 * 4/2020 Xu ..... F21K 9/272
10,794,580 B1 * 10/2020 Su ..... F21V 31/005
(Continued)

FOREIGN PATENT DOCUMENTS

CN 203628346 U 6/2014
CN 203703660 U 7/2014
(Continued)

OTHER PUBLICATIONS

International Search Report of PCT Application No. PCT/CN2019/096242 dated Oct. 28, 2019 with English translation, (6p).

*Primary Examiner* — Leah Simone Macchiarolo
(74) *Attorney, Agent, or Firm* — Arch & Lake LLP

(57) ABSTRACT

A linear luminaire is provided. The linear luminaire may include a housing body, two end caps, a face casing, and a back plate. The two end caps may be fixed onto two ends of the housing body. The housing body may include a top groove and a bottom groove. The top groove and the bottom groove may extend in a length direction with grooving openings oriented in opposite directions. The face casing may be fixedly clamped onto the groove opening of the top groove and forms an optical mixing cavity together with the top groove and the two end caps. The optical mixing cavity may be configured for accommodating a light-emitting circuit of the linear luminaire. The back plate may be clamped onto the groove opening of the bottom groove to form a power driving cavity together with the bottom groove and the two end caps.

16 Claims, 4 Drawing Sheets

(56) References Cited

U.S. PATENT DOCUMENTS

| | | | | |
|---|---|---|---|---|
| 2003/0185014 | A1* | 10/2003 | Gloisten | F21S 4/20 362/372 |
| 2005/0207166 | A1* | 9/2005 | Kan | F21V 29/89 362/373 |
| 2009/0144998 | A1* | 6/2009 | Lanczy | F21V 15/015 33/533 |
| 2010/0295468 | A1* | 11/2010 | Pedersen | F21S 10/02 315/294 |
| 2016/0053973 | A1 | 2/2016 | Tress et al. | |
| 2016/0327237 | A1* | 11/2016 | Hoch | F21V 17/164 |
| 2019/0309917 | A1* | 10/2019 | Santos | F21S 4/20 |
| 2020/0263843 | A1* | 8/2020 | Santos | F21V 3/00 |

FOREIGN PATENT DOCUMENTS

| | | | |
|---|---|---|---|
| CN | 204806087 | U | 11/2015 |
| CN | 206191437 | U | 5/2017 |
| CN | 206191524 | U | 5/2017 |
| CN | 206459095 | U | 9/2017 |
| CN | 207112696 | U | 3/2018 |
| CN | 208331861 | U | 1/2019 |
| CN | 208652156 | U | 3/2019 |

* cited by examiner

LINEAR LUMINAIRE

CROSS-REFERENCE TO RELATED APPLICATIONS

This application is a continuation of PCT patent application No. PCT/CN2019/096242 filed on Jul. 12, 2019 which claims priority to the Chinese patent application No. 201821124991.4 filed on Jul. 16, 2018, the entire contents of all of which are hereby incorporated by reference herein for all purposes.

TECHNICAL FIELD

The present disclosure relates to the technical field of luminaire design, and more particularly, to a linear luminaire.

BACKGROUND

With rising demand among users, more and more types of lighting luminaires are currently available on the market. A linear luminaire is a common lighting luminaire which can emit linear light. At present, linear luminaires have been extensively used in different environments such as shopping malls, factories, and scenic spots.

Linear luminaires play a role not only in lighting but also in decoration. Other surfaces of linear luminaires in addition to luminous surfaces may have significant advantages in sense quality and strength, and thus convey a sense of reliability and security. Thus, linear luminaires are deeply favored by users. Components of an existing linear luminaire are typically connected by threaded connecting elements, and the threaded connecting elements may be exposed at the exterior surface of the linear luminaire, which would affect the appearance of the linear luminaire. Moreover, numerous threaded connecting elements are required during assembling, rendering the assembling of the linear luminaire cumbersome, which will eventually lead to laborious and time-consuming disassembly of the linear luminaire.

SUMMARY

The present disclosure provides a linear luminaire.

According to a first aspect, the present disclosure provides a linear luminaire. The linear luminaire may include a housing body. The housing body may include a top groove and a bottom groove. The top groove and the bottom groove may extend in a length direction with grooving openings oriented in opposite directions. The linear luminaire may also include two end caps. The two end caps may be respectively fixed onto two ends of the housing body. The linear luminaire may also include a face casing. The face casing may be fixedly clamped onto the groove opening of the top groove and forms an optical mixing cavity together with the top groove and the two end caps. The optical mixing cavity may be configured for accommodating a light-emitting circuit of the linear luminaire. The linear luminaire may also include a back plate. The back plate may be clamped onto the groove opening of the bottom groove to form a power driving cavity together with the bottom groove and the two end caps. The power driving cavity may be configured for installing a driving circuit and wire connection terminals of the linear luminaire.

BRIEF DESCRIPTION OF THE DRAWINGS

The accompanying drawings, which are incorporated in and constitute a part of this specification, illustrate examples consistent with the present disclosure and, together with the description, serve to explain the principles of the disclosure.

DETAILED DESCRIPTION

Reference will now be made in detail to example embodiments, examples of which are illustrated in the accompanying drawings. The following description refers to the accompanying drawings in which the same numbers in different drawings represent the same or similar elements unless otherwise represented. The implementations set forth in the following description of example embodiments do not represent all implementations consistent with the disclosure. Instead, they are merely examples of apparatuses and methods consistent with aspects related to the disclosure as recited in the appended claims.

The terminology used in the present disclosure is for the purpose of describing particular embodiments only and is not intended to limit the present disclosure. As used in the present disclosure and the appended claims, the singular forms "a," "an," and "the" are intended to include the plural forms as well, unless the context clearly indicates otherwise. It shall also be understood that the term "and/or" used herein is intended to signify and include any or all possible combinations of one or more of the associated listed items.

It shall be understood that, although the terms "first," "second," "third," etc. may be used herein to describe various information, the information should not be limited by these terms. These terms are only used to distinguish one category of information from another. For example, without departing from the scope of the present disclosure, first information may be termed as second information; and similarly, second information may also be termed as first information. As used herein, the term "if" may be understood to mean "when" or "upon" or "in response to a judgment" depending on the context.

Figure 1:
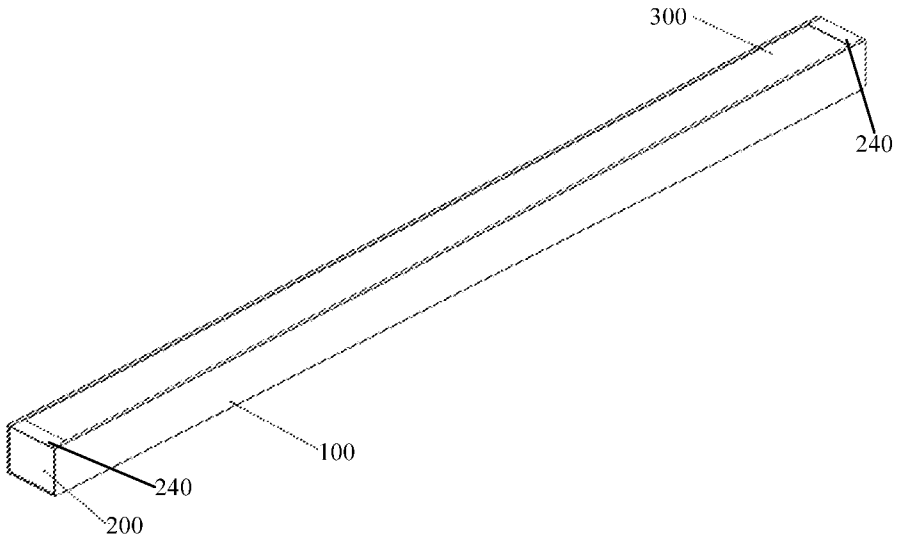
FIG. 1 is a structural schematic diagram of a linear luminaire at a view angle according to an embodiment of the present disclosure.
Figure 2:
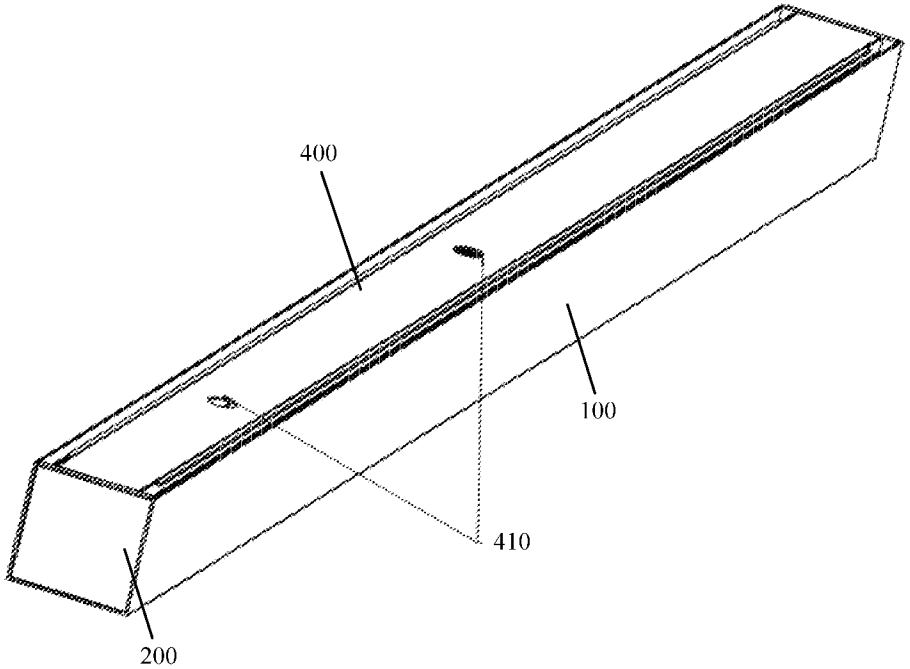
FIG. 2 is a structural schematic diagram of a linear luminaire at another view angle according to an embodiment of the present disclosure.
Figure 3:
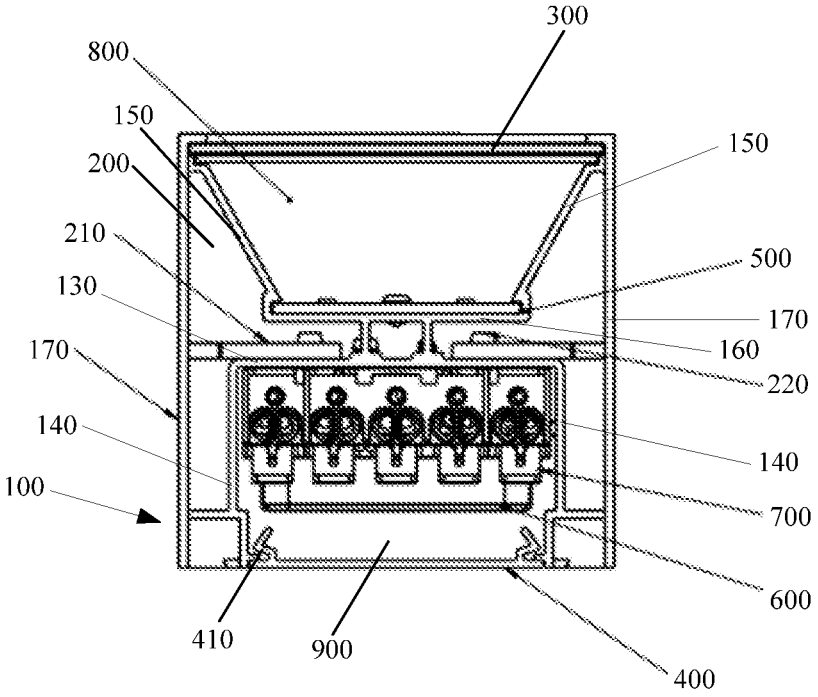
FIG. 3 is a structural schematic diagram of part of a linear luminaire according to an embodiment of the present disclosure, in which only one end cap is illustrated.
Figure 4:
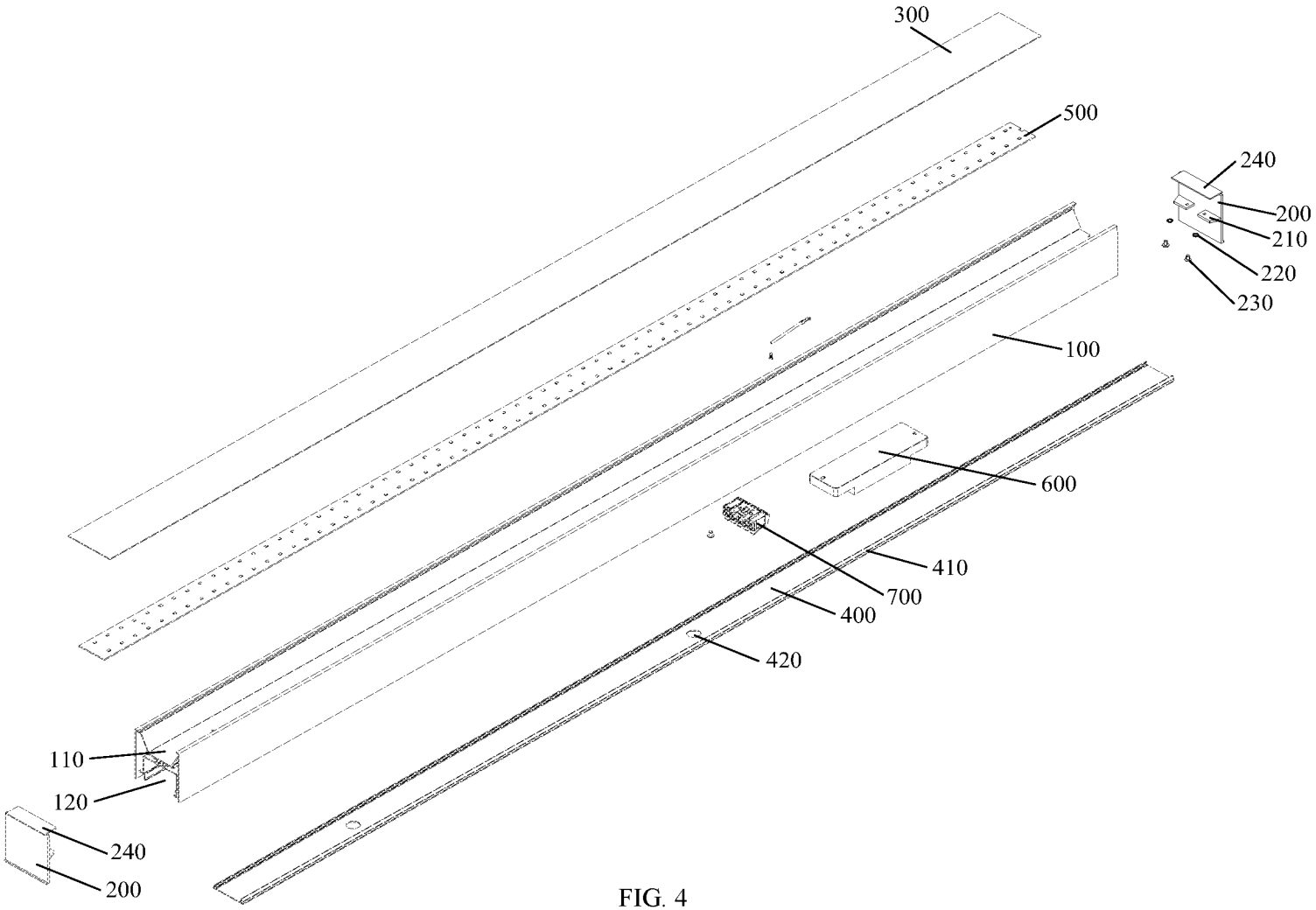
FIG. 4 is an exploded structural schematic diagram of a linear luminaire according to an embodiment of the present disclosure.

With reference to FIG. 1 to FIG. 4, an embodiment of the present disclosure provides a linear luminaire. The disclosed linear luminaire includes a housing body 100, two end caps 200, a face casing 300, and a back plate 400.

The housing body 100 is a main body of an outer housing of the linear luminaire. The housing body 100 provides installation positions for the two end caps 200, the face casing 300, as well as the back plate 400. The housing body 100 has a top groove 110 and a bottom groove 120. The top groove 110 and the bottom groove 120 both extend in a length direction of the housing body 100. The groove opening of the top groove 110 and the groove opening of the bottom groove 120 are oriented in opposite directions. The top groove 110, for example, may be away from the back plate 400. The bottom groove 120, for example, may be near the back plate 400.

The face casing 300 is used for light transmission, thus allowing light emitted by the linear luminaire to go out. The face casing 300 is fixedly clamped onto the groove opening of the top groove 110, and is configured to form an optical mixing cavity 800 together with the top groove 110 and the two end caps 200. The linear luminaire includes a light-emitting module 500. The optical mixing cavity 800 is configured to accommodate the light-emitting module 500. The light-emitting module 500, for example, may be a light-emitting circuit.

The back plate 400 is clamped onto the groove opening of the bottom groove 120, and is configured to form a power driving cavity 900 together with the bottom groove 120 and the two end caps 200. The linear luminaire further includes a driving module 600 and wire connection terminals 700. The driving module 600, for example, may be a driving circuit. The power driving cavity 900 is configured to receive the driving module 600 and the wire connection terminals 700. The back plate 400 is typically used as a mounting element for realizing overall installation of the linear luminaire. The back plate 400 is less liable to be seen, and thus has less influence on the appearance of the linear luminaire. Wiring perforations 420 are typically formed in the back plate 400. After penetrating through the wiring perforations 420, power supply wires are electrically connected to the wire connection terminals 700. The wire connection terminals 700 are electrically connected to the driving module 600. The driving module 600 is electrically connected to the light-emitting module 500 and is configured to drive the light-emitting module 500 to emit light.

In the linear luminaire disclosed in the embodiment of the present disclosure, the housing body 100 has the top groove 110 and the bottom groove 120. The face casing 300 and the back plate 400 are fixed onto the groove openings of the top groove 110 and the bottom groove 120 in a fixed clamping manner, thus, the face casing 300 and the back plate 400 are assembled with the housing body 100. During the above-mentioned assembling process, the face casing 300 and the back plate 400 are fixed without any threaded connecting elements, thereby avoiding the situation that the threaded connecting elements are exposed at the exterior surface of the linear luminaire, and better improving the appearance of the linear luminaire. Moreover, compared with the situation that threaded connecting elements are adopted, the fixed clamping manner is conducive to disassembly of the linear luminaire.

The light-emitting module 500 is arranged in the optical mixing cavity 800. Because the light-emitting module 500 is located within the linear luminaire, the installation of the light-emitting module 500 has no influence on the appearance of the linear luminaire. On this basis, the light-emitting module 500 may be installed in a variety of ways. For example, the light-emitting module 500 may be fixed in the optical mixing cavity 800 by using connecting elements (e.g., threaded connecting elements). From the perspective of disassembly, in in one or more embodiments, the light-emitting module 500 may also be fixed in the optical mixing cavity 800 in a clamping manner.

In an example, a first sliding groove may be disposed in the top groove 110, and both two ends of the first sliding groove have end openings. The light-emitting module 500 may slide into the first sliding groove from the end opening of the first sliding groove, and positioned in a depth direction of the first sliding groove by cooperating with the first sliding groove. Certainly, the light-emitting module 500 may slide into the first sliding groove under the driving of an external force, so as to be in tight fit with the first sliding groove by itself, thereby achieving the installation of the light-emitting module 500. In a situation that the external force is removed, the light-emitting module 500 can be retained at the installation position due to the friction between the light-emitting module 500 and the first sliding groove. The groove opening of the first sliding groove is located in the inner space of the top groove 110 and oriented in the same direction with the groove opening of the top groove 110. The light-emitting side of the light-emitting module 500 is oriented toward the groove opening of the first sliding groove, and the light emitted by the light-emitting module 500 is incident on the face casing 300 through the groove opening of the first sliding groove.

Certainly, the light-emitting module 500 may also be positioned along a sliding mounting direction under the assistance of other components. Specifically, each of the two ends of the light-emitting module 500 may be positioned by cooperating with the end cap 200 located at a same end of the linear luminaire. The end caps 200 are detachably fixed onto the housing body 100. During the installation process, the light-emitting module 500 penetrates the first sliding groove from the end opening of the first sliding groove, and then the end cap 200 located at the same end as the end opening is fixed onto the housing body 100.

The light-emitting module 500 may also slide into the first sliding groove directly from the groove opening of the first sliding groove and along the depth direction of the first sliding groove, so as to be fixedly clamped onto the first sliding groove.

A second sliding groove may be disposed at the groove opening of the top groove 110. The face casing 300 slides into the second sliding groove from an end opening of the second sliding groove. The face casing 300 is positioned in a depth direction of the second sliding groove by cooperating with the second sliding groove. Each of two ends of the face casing 300 is positioned by cooperating with the end cap 200 located at a same end of the linear luminaire. Two side edges of the face casing 300 are in sliding fit with the second sliding grooves located at two side edges of the top groove 110. After the face casing 300 slides into the second sliding grooves, the groove opening of the top groove 110 is sealed. Specifically, the position of the face casing 300 in itself may be achieved by means of the friction with the second sliding grooves. Certainly, the position of the face casing 300 in the sliding direction may also be achieved under the assistance of other components of the linear luminaire. For example, each of the two ends of the face casing 300 may be positioned by cooperating with the end cap 200 located at the same end of the linear luminaire.

The face casing 300 may have a variety of structures. Specifically, the face casing 300 may include a diffusing plate 310, and the diffusing plate 310 plays a role of making the light uniform. In one or more embodiments, the face casing 300 further includes a prism plate 320, and the prism plate 320 covers an outer plate-surface of the diffusing plate 310. The prism plate 320 plays a role of anti-glare. In this case, after being diffused by the diffusing plate 310, the light becomes more uniform, and then enter the prism plate 320.

Certainly, the face casing 300 may also have other structures. For example, the face casing 300 may include a transparent plate, a lens film, and a diffusing film; the lens film, and the diffusing film overlay the transparent plate. The diffusing film and the prism film are subsequently distributed along a light projection direction of the light-emitting module 500. After being diffused by the diffusing film and treated by the prism film, the uniform light projection can be obtained, and an anti-glare effect can be achieved. Specifically, the diffusing film and the prism film may be subsequently arranged on the inner surface of the transparent plate, or subsequently arranged on the outer surface of the transparent plate. Certainly, the diffusing film and the prism film may also be disposed on the inner surface and the outer surface of the transparent plate, respectively. Certainly, the transparent plate may be overlaid with only one of the diffusing film and the prism film.

In one or more embodiments, the number of the transparent plate may be two; the prism film and the diffusing film are disposed between the two transparent plates. Two transparent plates can achieve better protection for both the prism film and the diffusing film, thereby avoiding easy damage to the prism film and diffusing film due to their exposure in the air.

In the embodiment, the housing body 100, the two end caps 200, and the back plate 400 may be metallic structural elements or plastic structural elements. In most cases, the housing body 100 and the two end caps 200 are easily seen by the users after the linear luminaire is installed. The back plate 400 is less liable to be seen, because the back plate 400 is attached to an installation surface (e.g., indoor ceiling). On this basis, in in one or more embodiments, the housing body 100 and the two end caps 200 are metallic structural elements, while the back plate 400 is a plastic structural element or a metallic structural element. The housing body 100 and the two end caps 200 are metallic structural elements, which can increase the sense quality in the appearance of the linear luminaire.

In the embodiment, the bottom groove 120 is located at a bottom of the housing body 100, while the top groove 110 is located at a top of the housing body 100. Two sidewalls 170 of the housing body 100 may directly consist of the bottom groove 120 and the top groove 110. In in one or more embodiments, first lining walls 140 may be disposed at the bottom inner sides of the two sidewalls 170 of the housing body 100, and a first connecting plate 130 is provided for connecting the two first lining walls 140. The two first lining walls 140 and the first connecting plate 130 form the bottom groove 120. In this case, the back plate 400 may be fixedly clamped onto the groove opening formed by the two first lining walls 140, i.e., clamped between the two first lining walls 140. During this process, there is no need to fixedly clamp the back plate 400 directly with the two sidewalls 170 of the housing body 100, thus, the gap are easy to be seen while the back plate 400 is directly clamped with the sidewalls 170 of the housing body 100 can be avoided more readily, which undoubtedly further ensures that the back plate 400 can be concealed better after the installation.

Similarly, second lining walls 150 may be disposed at top inner sides of the two sidewalls 170 of the housing body 100, and a second connecting plate 160 is provided for connecting the two second lining walls 150. Two second lining walls 150 and the second connecting plate 160 may form the top groove 110. As described above, the top groove 110 and the face casing 300 can form the optical mixing cavity 800. Typically, the surfaces of groove walls of the top groove 110 are reflecting surfaces. Because the top groove 110 may be formed without the sidewalls 170 of the housing body 100, a designer can adjust the gradient of the reflecting surfaces more flexibly by adjusting the gradient of the second lining walls 150, with no influence on the shape of the sidewalls 170 of the housing body 100, namely no influence on the appearance property of the linear luminaire.

On the basis that the housing body 100 and the two end caps 200 are metallic structural elements, in in one or more embodiments, third connecting plates 210 may be disposed on the inner side surfaces of the two end caps 200. The third connecting plates 210 may be fixedly connected to the first connecting plate 130 by grounding screws 220. In this case, the first connecting plate 130 plays a role of assist the fixation of the end caps 200. The two end caps 200 may be connected to the third connecting plates 210 and the first connecting plate 130 by the grounding screws, thereby achieving the connection with the housing body 100. The grounding screws 220 is electrically conductive, thus realizing grounding connections of both the end caps 200 and the grounding structures of the housing body 100. In this case, during the assembling process, the two end caps 200 may be first fixed to the housing body 100 by the grounding screws 220, and then the back plate 400 may be installed. Because the grounding screws 220 is overlaid by the back plate 400 after the back plate 400 is installed, no connecting elements such as screws can be seen from the exterior of the entire lighting luminaire, and it doesn't influence on the appearance of the lighting luminaire.

Certainly, the third connecting plates 210 may also be fixedly connected to the second connecting plate 160 by grounding screws 220. Certainly, the housing body 100 may be provided with other structures for fixedly connecting with the third connecting plates 210 by grounding screws 220, which may not be limited to the first connecting plate 130 and the second connecting plate 160.

The third connecting plate 210 and the first connecting plate 130 are metallic structures. In practical connection process, oxide layers may be formed on the third connecting plate 210 and the first connecting plate 130 due to natural oxidation, which affects the electrically conductive connection between the third connecting plate 210 and the first connecting plate 130. On this basis, in in one or more embodiments, an outer serrated gasket 230 may sleeve the grounding screw 220. The outer serrated gasket 230 may be in contact with the third connecting plate 210 or the first connecting plate 130. While the grounding screw 220 is tightened, the outer serrated gasket 230 is pressed down, so that the outer serrated gasket 230 crushes the oxide layer and then electrically contacts the metallic portion at an inner side of the oxide layer, thus guaranteeing grounding electrical connection. Certainly, the two end caps 200 may also be connected to the housing body 100 in a fixed clamping manner.

Referring again to FIG. 3, the back plate 400 may be provided with fasteners 410 extending in a length direction of the back plate 400. The fasteners 410 may be fixedly clamped onto the groove opening of the bottom groove 120 in the depth direction of the bottom groove 120. During the assembling process, an operator may press the back plate 400 along the depth direction of the bottom groove 120, thereby realizing the installation of the back plate 400.

To further improve the appearance property of the linear luminaire, in in one or more embodiments, the ends of the two end caps 200 opposed against the face casing 300 are provided with package edgings 240, and the package edgings 240 wrap the ends of the face casing 300. Thus, the assembling gaps between the end caps 200 and the housing body 100 can be avoided from being exposed in the air.

It is noted that a groove opening used in the disclosure refers to an opening opposite to an inner bottom surface of a groove (the first sliding groove, the top groove 110, the bottom groove 120, etc.). An end opening of a groove refers to an opening at an end of the groove and in an extending direction of the groove. In a situation that one end of the groove is an open end, the opening at the one end is called the end opening of the groove. In a situation that two ends of the groove are open ends, the openings at the two ends of the groove are end openings. In addition, a depth direction of a groove in the disclosure refers to a direction from the groove opening to the inner bottom surface of the groove, or refers to a direction from the inner bottom surface to the groove opening of the groove.

In the above linear luminaire, a first sliding groove is disposed in the top groove; the light-emitting module slides into the first sliding groove from the end opening of the first sliding groove, and positioned in a depth direction of the first sliding groove by cooperating with the first sliding groove; each of two ends of the light-emitting module is positioned by cooperating with the end cap located at a same end of the linear luminaire.

In the above linear luminaire, a second sliding groove is disposed at the groove opening of the top groove; the face casing slide into the second sliding groove from an end opening of the second sliding groove, and positioned in a depth direction of the second sliding groove by cooperating with the second sliding groove; and each of two ends of the face casing is positioned by cooperating with the end cap located at a same end of the linear luminaire.

In the above linear luminaire, the face casing comprises a diffusing plate.

In the above linear luminaire, the face casing further comprises a prism plate covering an outer plate-surface of the diffusing plate.

In the above linear luminaire, the face casing comprises a transparent plate, a prism film and a diffusing film; the prism film and the diffusing film overlay the transparent plate; the diffusing film and the prism film are subsequently distributed in a light projection direction of the light-emitting module.

In the above linear luminaire, the face casing comprises two transparent plates, the prism film and the diffusing film are disposed between the two transparent plates.

In the above linear luminaire, the housing body and the two end caps are metallic structural elements.

In the above linear luminaire, the back plate is a plastic structural element or a metallic structural element.

In the above linear luminaire, third connecting plates are disposed on inner side surfaces of the two end caps; a first connecting plate is disposed within the housing body; the third connecting plates are fixedly connected to the first connecting plate by grounding screws.

In the above linear luminaire, an outer serrated gasket sleeves the grounding screw, and is the outer serrated gasket is in contact with the third connecting plate or the first connecting plate.

In the above linear luminaire, the two end caps are fixedly clamped onto two ends of the housing body, respectively.

In the above linear luminaire, the back plate is provided with fasteners extending in a length direction of the back plate; and the fasteners are fixedly clamped onto the groove opening of the bottom groove in a depth direction of the bottom groove.

In the above linear luminaire, first lining walls are disposed at bottom inner sides of two sidewalls of the housing body; the first connecting plate is connected between two first lining walls, the two first lining walls and the first connecting plate form the bottom groove; and the back plate is fixedly clamped between the two first lining walls.

In the above linear luminaire, second lining walls are disposed at top inner sides of two sidewalls of the housing body; a second connecting plate is connected between two second lining walls, the two second lining walls and the second connecting plate form the top groove; and the face casing is clamped between the two second lining walls.

In the above linear luminaire, ends of the two end caps opposed against the face casing are provided with package edgings, and the package edgings wrap the ends of the face casing.

The technical improvements adopted by the present disclosure can achieve the following beneficial effects:

In the linear luminaire disclosed in the present disclosure, the housing body has top and bottom grooves, the face casing and the back plate are clamped at the groove openings of the top groove and the bottom groove. Thus, the face casing and the back plate are assembled with the housing body. During the above-mentioned assembling process, the face casing and the back plate are fixed without any threaded connecting elements, thereby avoiding the situation that the threaded connecting elements are exposed at the exterior surface of the linear luminaire, and better improving the appearance of the linear luminaire. Moreover, compared with the situation that threaded connecting elements are adopted, the fixed clamping manner is conducive to disassembly of the linear luminaire.

In the disclosure, the technical features can be combined to form an improvement as long as there is no contradiction, and these improvements are all within the scope disclosed by the present disclosure.

It should be understood that the foregoing embodiments merely are specific embodiments of the present disclosure, and not intended to limit the present disclosure. Any modification, equivalent substitution, improvement, and the like, made within the spirit and principles of the present disclosure should be covered within the protection scope of the present disclosure.

What is claimed is:

1. A linear luminaire, comprising:

a housing body, wherein the housing body comprises a top groove and a bottom groove, the top groove and the bottom groove extend in a length direction with grooving openings oriented in opposite directions;

two end caps, wherein the two end caps are respectively fixed onto two ends of the housing body;

a face casing, wherein the face casing is fixedly clamped onto the groove opening of the top groove and forms an optical mixing cavity together with the top groove and the two end caps, the optical mixing cavity is configured for accommodating a light-emitting circuit of the linear luminaire;

a back plate, wherein the back plate is clamped onto the groove opening of the bottom groove to form a power driving cavity together with the bottom groove and the two end caps, the power driving cavity is configured for installing a driving circuit and wire connection terminals of the linear luminaire; and a pair of third connecting plates disposed on an inner side surface of each end cap, wherein the inner side surface of each end cap faces toward the top groove and the bottom groove, the pair of third connecting plates are located within the inner side surface other than edges of each end cap, the pair of third connecting plates are fixedly connect to a first connecting plate via ground screws, wherein the first connecting plate and two first lining walls form the bottom groove, and the back plate is fixedly clamped between the two first lining walls.

2. The linear luminaire according to claim 1, wherein a first sliding groove is disposed in the top groove, wherein the light-emitting circuit slides into the first sliding groove from the end opening of the first sliding groove, and positioned in a depth direction of the first sliding groove by cooperating with the first sliding groove, wherein each of two ends of the light-emitting circuit is positioned by cooperating with the end cap located at a same end of the linear luminaire.

3. The linear luminaire according to claim 2, wherein a second sliding groove is disposed at the groove opening of the top groove, wherein the face casing slide into the second sliding groove from an end opening of the second sliding groove, and positioned in a depth direction of the second sliding groove by cooperating with the second sliding groove, and wherein each of two ends of the face casing is positioned by cooperating with the end cap located at a same end of the linear luminaire.

4. The linear luminaire according to claim 1, wherein the face casing comprises a diffusing plate.

5. The linear luminaire according to claim 4, wherein the face casing further comprises a prism plate covering an outer plate-surface of the diffusing plate.

6. The linear luminaire according to claim 1, wherein the face casing comprises a transparent plate, a prism film and a diffusing film, wherein the prism film and the diffusing film overlay the transparent plate, wherein the diffusing film and the prism film are subsequently distributed in a light projection direction of the light-emitting circuit.

7. The linear luminaire according to claim 6, wherein the face casing comprises two transparent plates, the prism film and the diffusing film are disposed between the two transparent plates.

8. The linear luminaire according to claim 1, wherein the housing body and the two end caps are metallic structural elements.

9. The linear luminaire according to claim 8, wherein the back plate is a plastic structural element or a metallic structural element.

10. The linear luminaire according to claim 8, wherein the first connecting plate is disposed within the housing body.

11. The linear luminaire according to claim 10, wherein an outer serrated gasket sleeves the grounding screw, and is the outer serrated gasket is in contact with the third connecting plate or the first connecting plate.

12. The linear luminaire according to claim 1, wherein the two end caps are fixedly clamped onto two ends of the housing body, respectively.

13. The linear luminaire according to claim 1, wherein the back plate is provided with fasteners extending in a length direction of the back plate, and wherein the fasteners are fixedly clamped onto the groove opening of the bottom groove in a depth direction of the bottom groove.

14. The linear luminaire according to claim 13, wherein the first lining walls are disposed at bottom inner sides of two sidewalls of the housing body, wherein the first connecting plate is provided for connecting two first lining walls.

15. The linear luminaire according to claim 1, wherein second lining walls are disposed at top inner sides of two sidewalls of the housing body, wherein a second connecting plate is provided for connecting two second lining walls, the two second lining walls and the second connecting plate form the top groove, and wherein the face casing is clamped between the two second lining walls.

16. The linear luminaire according to claim 1, wherein ends of the two end caps opposed against the face casing are provided with package edgings, and the package edgings wrap the ends of the face casing.

* * * * *